US007441741B2

(12) United States Patent
Wong

(10) Patent No.: US 7,441,741 B2
(45) Date of Patent: Oct. 28, 2008

(54) HANGER APPARATUS AND METHOD

(76) Inventor: Hammond Wong, 2843 Trish Way, West Covina, CA (US) 92791

( * ) Notice: Subject to any disclaimer, the term of this patent is extended or adjusted under 35 U.S.C. 154(b) by 88 days.

(21) Appl. No.: 11/309,752

(22) Filed: Sep. 22, 2006

(65) Prior Publication Data

US 2008/0073476 A1 Mar. 27, 2008

(51) Int. Cl.
*A47G 1/24* (2006.01)
*B60R 1/02* (2006.01)

(52) U.S. Cl. ..... 248/477; 248/475.1; 248/497; 248/489; 248/467

(58) Field of Classification Search ..... 248/475.1, 248/477, 497, 489, 467
See application file for complete search history.

(56) References Cited

U.S. PATENT DOCUMENTS

| | | | | | |
|---|---|---|---|---|---|
| 2,492,411 | A | | 12/1949 | Barnes et al. | 248/29 |
| 3,622,116 | A | * | 11/1971 | Fellows | 248/467 |
| 3,865,342 | A | * | 2/1975 | Kanzelberger | 248/470 |
| 4,228,982 | A | * | 10/1980 | Sellera | 248/467 |
| 4,262,874 | A | * | 4/1981 | Seigh | 248/467 |
| 4,336,884 | A | | 6/1982 | Hart | 206/575 |
| 4,384,648 | A | | 5/1983 | Hart | 206/527 |
| 4,611,780 | A | * | 9/1986 | Robertson | 248/477 |
| D302,108 | S | * | 7/1989 | Fenton | D8/373 |
| 4,871,140 | A | * | 10/1989 | Hoskinson et al. | 248/496 |
| 5,398,906 | A | * | 3/1995 | Aydelott | 248/547 |
| 5,433,416 | A | * | 7/1995 | Johnson | 248/475.1 |
| 5,605,313 | A | * | 2/1997 | Erickson et al. | 248/467 |
| 6,095,465 | A | | 8/2000 | Weck | 248/205.3 |
| 6,102,461 | A | * | 8/2000 | Rooney et al. | 294/142 |
| 6,186,466 | B1 | * | 2/2001 | Baird et al. | 248/475.1 |
| 6,245,177 | B1 | * | 6/2001 | Luhmann | 156/182 |
| 6,719,260 | B1 | * | 4/2004 | Hart | 248/479 |
| 7,216,841 | B2 | * | 5/2007 | Dodig, Jr. | 248/475.1 |
| 7,237,349 | B2 | * | 7/2007 | Huang | 40/606.14 |
| 2003/0038222 | A1 | * | 2/2003 | Holmes | 248/475.1 |
| 2004/0084598 | A1 | | 5/2004 | Dodig, Jr. | 248/475.1 |
| 2005/0006554 | A1 | * | 1/2005 | DeLine | 248/475.1 |
| 2006/0054771 | A1 | * | 3/2006 | Lie | 248/489 |
| 2006/0113454 | A1 | * | 6/2006 | Douglas | 248/477 |

* cited by examiner

*Primary Examiner*—Brian Glessner
*Assistant Examiner*—Michael McDuffie
(74) *Attorney, Agent, or Firm*—Walter J. Tencza, Jr

(57) ABSTRACT

A method is disclosed, which may include attaching an apparatus to a picture frame, and removing an adhesive cover from the apparatus to reveal an adhesive surface. While the apparatus, without the adhesive cover, is still attached to the picture frame, the apparatus can be pressed against a surface of a wall so that the adhesive surface adheres to the surface of the wall. The method may further include detaching a first part of the apparatus from a second part of the apparatus so that the first part of the apparatus remains attached to the picture frame and the second part of the apparatus adheres to the wall. Fasteners may be inserted into the wall using the second part of the apparatus as a guide, and the first part of the apparatus and the picture frame may be hung from the fasteners.

9 Claims, 10 Drawing Sheets

HANGER APPARATUS AND METHOD

FIELD OF THE INVENTION

This invention relates to improved methods and apparatus concerning hanging frames (precisely) on a wall.

BACKGROUND OF THE INVENTION

Individuals usually guess or make a rough estimate about where picture frames need to be hung. In order to make it right, the most common way is to measure the distance from the top of a ceiling to a top of the picture frame, and then the distance from the left to the right of the wall, and then to mark down the center point where the frame is about to be hung. Even after an individual has found the center point, there are still difficulties for the individual to hang the particular picture frame the precisely to the place they want. To get more precise measurement, they need to: (a) match the center point that they mark down on the wall to the center point of the frame; (b) calculate the exact distance from the top of the wire at the back of the frame to the top of the frame; (c) know the design of the metal hanger, the measurement from the top of the hanger to the hook; and (d) know the tension of the wire. Usually nails are applied on the wall along with metal hangers. However, the nails may be removed and reapplied repeatedly on the wall if the position of the frame is incorrect, causing physical damage to the wall. It's a tedious and time consuming process, which requires professional skill to handle.

There are various devices known in the prior art for hanging picture frames. U.S. Pat. No. 4,336,884 to Hart et. al. discloses a picture frame hanging backing sheet 10. (Hart et. al, FIG. 1). The sheet 10 includes adhesive areas 44 for releasably adhering to a picture frame and adhesive areas 48 for releasably adhering to a wall. (Hart et. al, FIGS. 1 and 2). Hangers 12 are inserted into slots in the backing sheet 10. (Id.) In operation, the adhesive areas 44 are adhered to the back of a picture frame (with the hangers 12 inserted into the sheet 10), such that a wire 52 at the back of the frame is hung over the hangers 12 and is slightly tensioned. (Hart et. al, FIGS. 1 2, 4*a*, col. 5, Ins. 1-10). Next the adhesive areas 48 are pressed against a wall, and adhered to the wall, causing the sheet 10 to be adhered to the wall. Next the picture frame is removed from the sheet 10, by releasing the adhesive areas 44 from the picture frame and by removing the wire 52 from the hangers 12. With the sheet 10 adhered to the wall by adhesive areas 48, and the hangers 12 inserted into the sheet 10, the hangers 12 are fixed to the wall by, for example, hammering nails into the hangers 12. (Hart et. al., FIG. 4*b*). Each of the hangers 12 has a single opening for a nail. (Hart et. al., FIG.1). Next, the sheet 10 is removed from the hangers 12, leaving the hangers 12 nailed into the wall. (Hart et al., FIG. 4*c*). The picture frame can then be hung by draping the wire 52 over the hangers 12.

U.S. Pat. No. 6,095,465 to Weck et. al. discloses a picture hanger member 12 with a triangular shaped base 14 and an opening 20. (Weck et. al., FIG.1, col. 4, Ins. 60-65). A temporary adhesive 46 is attached to a hanger member 12. (Weck, FIG.1). The hanger member 12 can be temporarily attached to a wall 34, by adhesive 46 and then moved if the hanger member 12 is not at the correct position. (Weck, col. 5, Ins. 48-60). The hanger member 12 includes three nail receiving guide holes 22 within three guides or protrusions 28. (Weck, FIG.2). Nails can be driven through a shock absorbing layer 40 to fix the hanger member 12 to the wall 34. (Weck, Fig., col. 5 In. 48-col. 6, In. 56).

U.S. Pat. No. 3,622,116 to Fellows, discloses a tongue member 10 which is fixed to a picture frame 26 and then inserted into a bracket member 30 fixed to a supporting surface 32. (Fellows, FIGS.1-8). U.S. Pat. No. 4,228,982 to Sellera discloses a wall pad 16 and a frame pad 22. (Sellera, col. 1, In. 50-col. 2, In. 30). The wall pad 16 and the frame pad 22 have adhesives which adhere to a wall and a back of a picture frame, respectively. (Id.). The frame pad 22 has a downward extension 82 which can be inserted into a pocket 53 of the wall pad 16 to hang a picture frame onto a wall. (Id.) U.S. Pat. No. 2,492,411 to Barnes provides a resilient member 29 which adheres to a wall and a picture frame to keep the frame straight. (Barnes, col. 2, In. 44-col. 3, In. 29). U.S. Patent Application No. US 2004/0084598 A1 to Dodig, J R. discloses a mounting carrier 22 having a pair of hooks 20. (Dodig, p2, paragraph 19-paragraph 25). The carrier 22 is mounted on a wall 14 and thereafter a picture 12 is hung by a wire from 18 from the hooks 20. (Dodig, Id.).

SUMMARY OF THE INVENTION

One embodiment of the present invention, provides a method for hanging a picture frame. The method may include attaching an apparatus to a picture frame using a first set of one or more fasteners, and removing an adhesive cover from the apparatus to reveal an adhesive surface. The method may also include, while the apparatus, without the adhesive cover, is still attached to the picture frame, pressing the apparatus against a surface of a wall so that the adhesive surface adheres to the surface of the wall. The method may further include detaching a first part of the apparatus from a second part of the apparatus so that the first part of the apparatus remains attached to the picture frame by the first set of one or more fasteners and the second part of the apparatus adheres to the wall. Additionally, the method may include inserting a second set of one or more fasteners into the wall using the second part of the apparatus as a guide, and hanging the first part of the apparatus from the second set of one or more fasteners so that the picture frame also hangs from the second set of one or more fasteners.

One embodiment of the present invention provides an apparatus for hanging a picture frame including an adhesive cover, an adhesive surface, a guide cap, and a hanger. The adhesive cover, the adhesive surface, the guide cap, and the hanger may be attached to each other. The apparatus can be attached to a picture frame using a first set of one or more fasteners. The adhesive cover can be removed from the apparatus to reveal the adhesive surface. While the apparatus, without the adhesive cover, is still attached to the picture frame by the first set of one or more fasteners, the apparatus can be pressed against a surface of a wall so that the adhesive backing adheres to the surface of the wall. The hanger can be detached from the guide cap so that the hanger remains attached to the picture frame by the first set of one or more fasteners and the guide cap adheres to the wall. A second set of one or more fasteners can be inserted into the wall using the guide cap as a guide, and the hanger can be hung from the second set of one or more fasteners so that the picture frame also hangs from the second set of one or more fasteners.

DETAILED DESCRIPTION OF THE DRAWINGS

Figure 1:
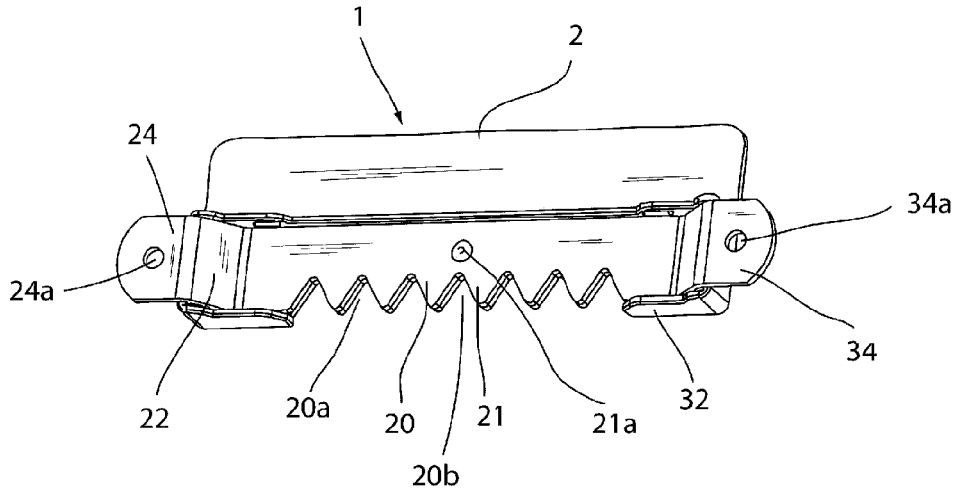
FIG. 1 shows a perspective view of an apparatus including a hanger and guide cap in accordance with an embodiment of the present invention.
Figure 2A:
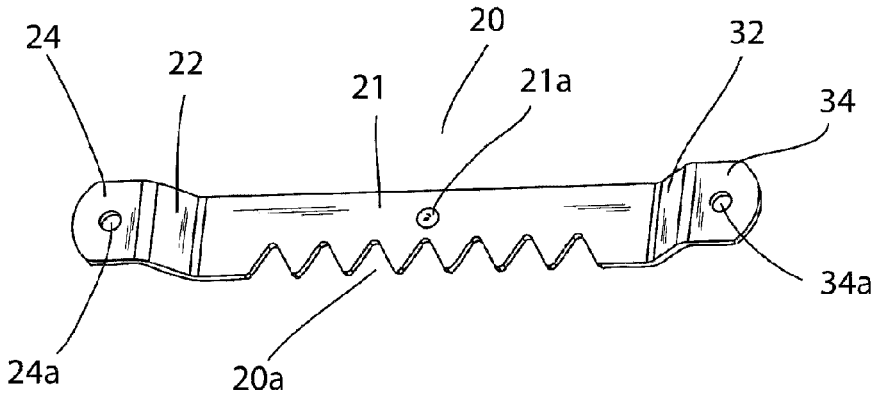
FIG. 2A shows a rear perspective view of the hanger of FIG. 1.
Figure 2B:
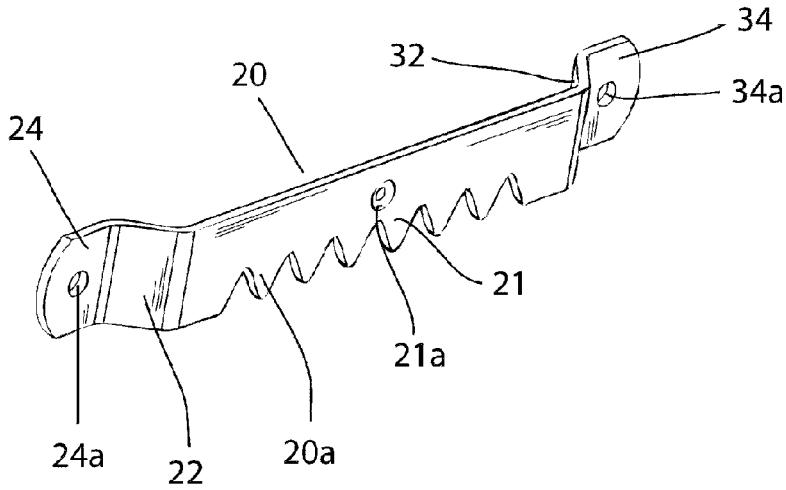
FIG. 2B shows a front perspective view of the hanger of FIG. 1.

FIG. 1 shows a perspective view of an apparatus 1 including a hanger 20 and a guide cap 2 in accordance with an embodiment of the present invention. FIG. 2A shows a rear perspective view of the hanger 20 and FIG. 2B shows a front perspective view of the hanger 20. The hanger 20 may include a plate 21 having a central circular protrusion 21*a* and teeth 20*a*. The hanger 20 may also include inclined plates 22 and 32 and plates 24 and 34. The plate 21 is connected at a first end to plate 22 and at a second opposite end to plate 32. The inclined plate 22 is connected at one end to plate 21 and at another end to plate 24. The inclined plate 32 is connected at one end to plate 21 and at another end to plate 34. The plates 24 and 34 have central circular openings 24*a* and 34*a*, respectively. The hanger 20 may be made of a rigid metal material.

Figure 3:
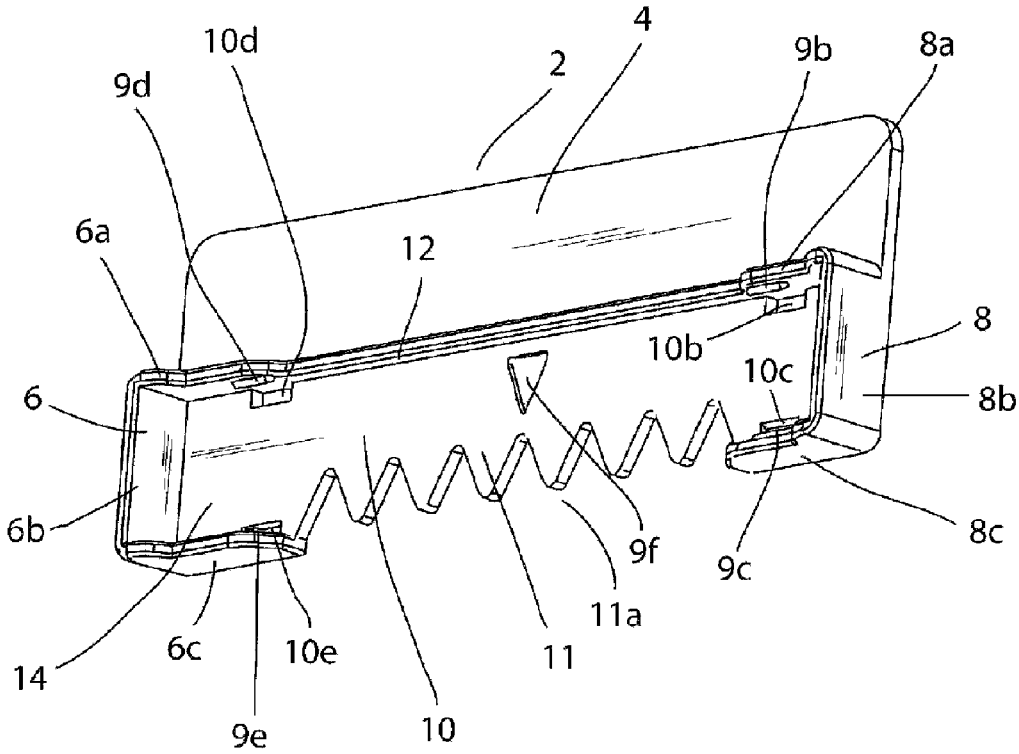
FIG. 3 shows a rear perspective view of the guide cap of FIG. 1.

FIG. 3 shows a rear perspective view of the guide cap 2. The guide cap 2 may include plate 4, which is connected to plate 10. Plate 4 may be parallel to plate 10. The guide cap 2 may also include section 6, which includes plates 6*a*, 6*b*, and 6*c*, which may be perpendicular to plate 10. The guide cap 2 may also include section 8, which includes plates 8*a*, 8*b*, and 8*c*, which may be perpendicular to plate 10. There may be a plate 12 which is perpendicular to plates 4 and 10 and which connects plates 4 and 10. Plate 10 includes a triangular opening 9*f*. Plate 10 also includes teeth 11, including a tooth 11*a*. The sections 6*a*, 6*b*, 6*c*, plate 12, sections 8*a*, 8*b*, and 8*c*, substantially define a partially enclosed area into which the hanger 20 can be inserted as shown in FIG. 1. The guide cap 2 may be made of plastic material. FIG. 3 also shows openings 10*b*, 10*c*, 10*d*, and 10*e* in the plate 10. FIG. 3 also shows protrusions 9*b*, 9*c*, 9*d*, and 9*e*.

Figure 4A:
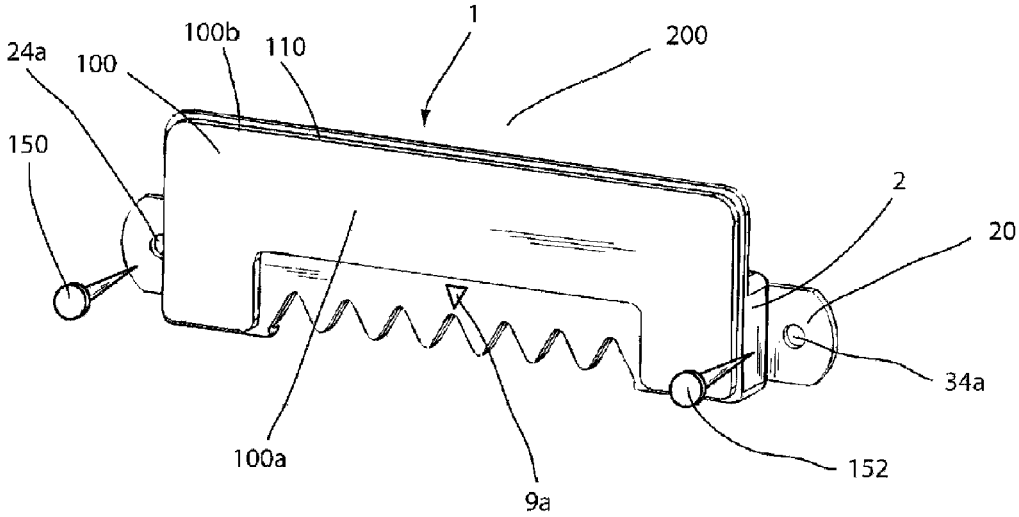
FIG. 4A shows a front perspective view of two fasteners, and the hanger and guide cap of FIG. 1 assembled together with a cover and a foam covered with adhesives.
Figure 4B:
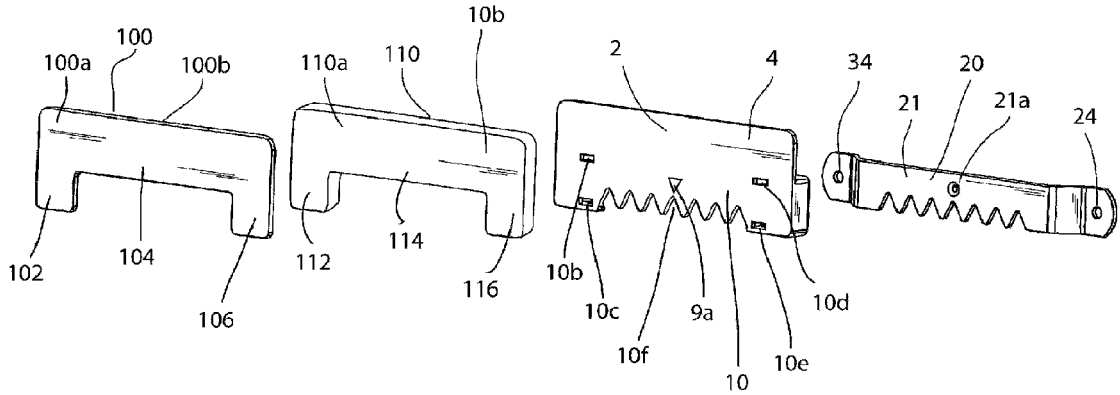
FIG. 4B shows a front perspective view of the hanger, guide cap, cover, and foam covered with adhesives of FIG. 4A taken apart.

FIG. 4A shows a front perspective view of an apparatus 200, including the hanger 20 and the guide cap 2 of FIG. 1 assembled together with a cover 100 (or tape) and a foam 110 covered with adhesives. FIG. 4B shows a front perspective view of the hanger 20, the guide cap 2, cover 100, and foam 110 covered with adhesives of FIG. 4A taken apart. The cover 100 may be U-shaped and may include sections 102, 104, and 106. The foam 110 may also be U-shaped and may include sections 112, 114, and 116. The cover 100 is designed to cover the surface 110*a* of the foam 110 and therefore has a rear surface 100*a*, which has the same area as surface 110*a*. The sections 102, 104, and 106 may align with and have the same area as the sections 112, 114, and 116. The cover 100 has a non-adhesive back surface 100*b*, shown by FIGS. 4A-B and FIG. 6.

FIG. 4B shows rear surfaces of the plates 4 and 10, which are integrated together. FIG. 4B also shows square openings 10*b*, 10*c*, 10*d*, and 10*e* of the plate 10. The square openings 10*b-e* are for tooling purposes. FIG. 4B also shows the triangular protrusion 9*a*, which is used as a mark to align the apparatus 1 of FIG. 1 with the center of a picture frame, such as picture frame 300 shown in FIGS. 6-8. In the view of FIG. 4A and FIG. 4B, the triangular protrusion 9*a* protrudes outwards. FIG. 5B shows a triangular indentation 9*f* corresponding to the triangular protrusion 9*a*.

Figure 5A:
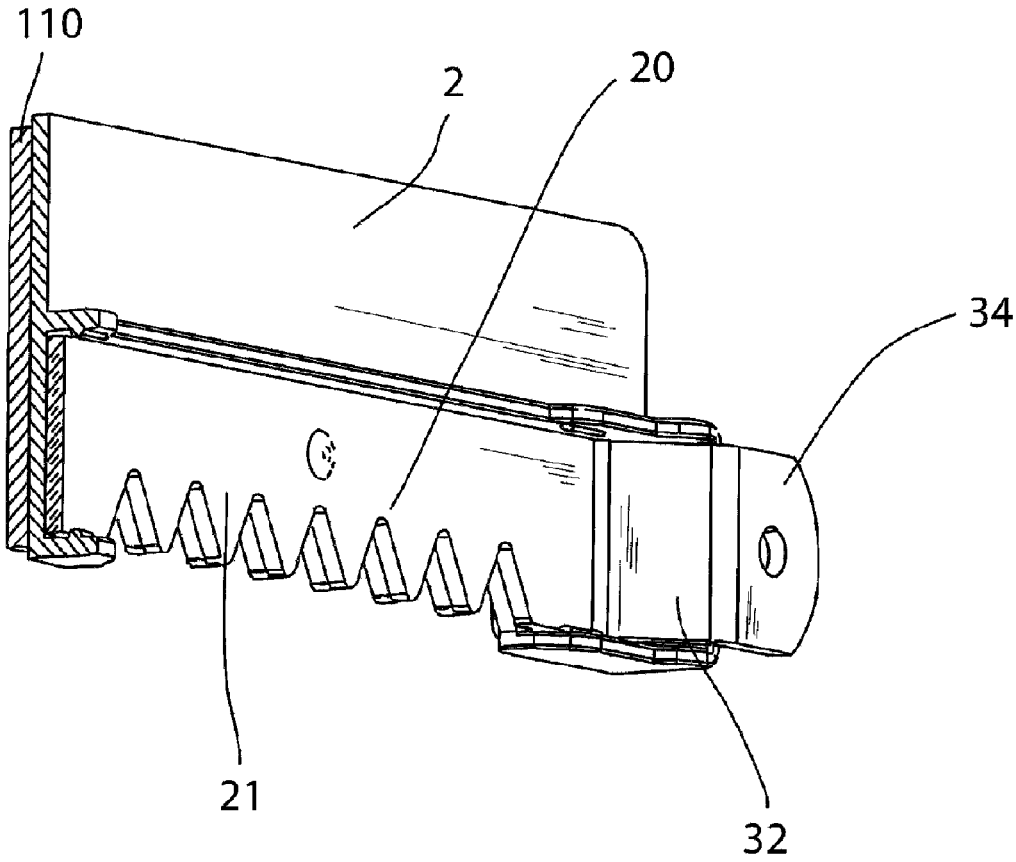
FIG. 5A shows a cross sectional view of the hanger, guide cap, and foam covered with adhesives of FIG. 4B.
Figure 5B:
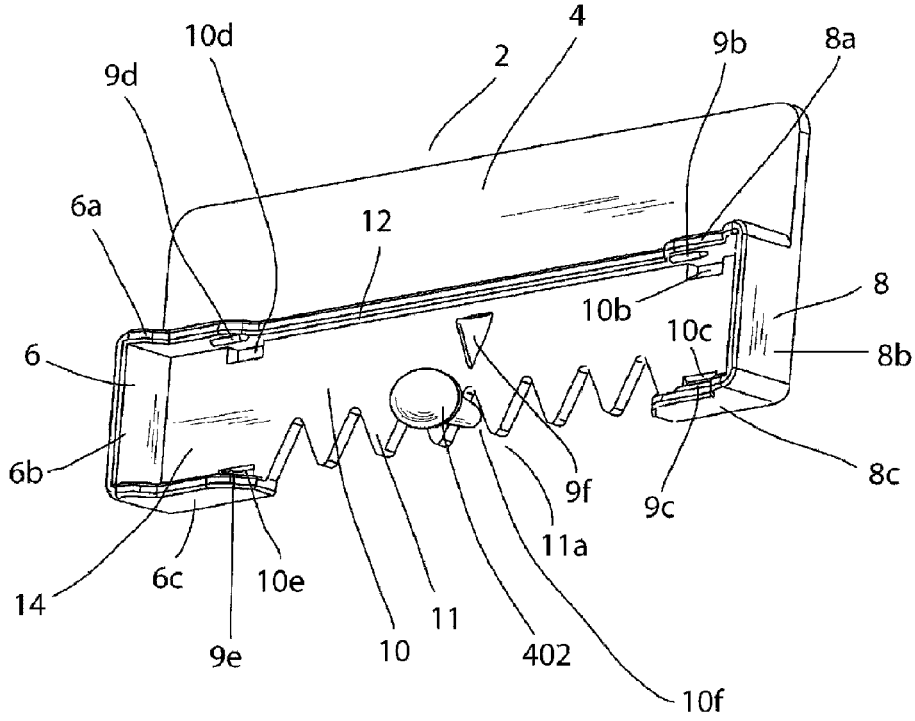
FIG. 5B shows a rear perspective view of the guide cap of FIG. 1, with a fastener inserted below the guide cap of FIG. 1.

FIG. 5A shows a cross sectional view of the hanger 20, guide cap 2, and foam 110.

FIG. 5B shows a rear perspective view of the guide cap 2, with a fastener 402 inserted below the guide cap 2. between two teeth of teeth 11.

Figure 6:
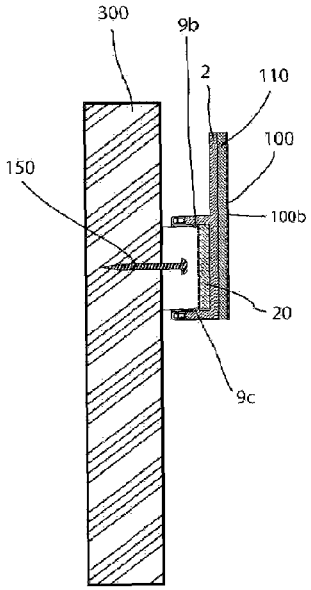
FIG. 6 shows a cross sectional view of the hanger, the guide cap, the foam covered with adhesives, and the cover (or tape) of FIG. 4B, a wood frame, and a first fastener in a first state.

FIG. 6 shows a cross sectional view of the hanger 20, the guide cap 2, the foam 110, and the cover 100 (or tape), a wood frame 300, and a first fastener(s) 150 in a first state. The first fastener 150 may be a nail or screw. Fastener 152 may be located parallel to the fastener 150 as shown in FIG. 4A. In the first state, the first fastener 150 may have been screwed in or nailed through opening 34*a* and fastener 152 may be screwed in or nailed through opening 24*a* into frame 300.

Figure 7:
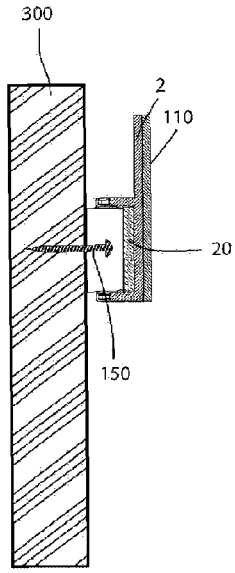
FIG. 7 shows a cross sectional view of the hanger, the guide cap, the wood frame, the foam covered with adhesives, and the first fastener in a second state, wherein the cover (tape) has been removed.

FIG. 7 shows a cross sectional view of the hanger 20, the guide cap 2, the wood frame 300, the foam 110, and the first fastener 150 in a second state, wherein the cover 100 (tape) has been removed.

Figure 8:
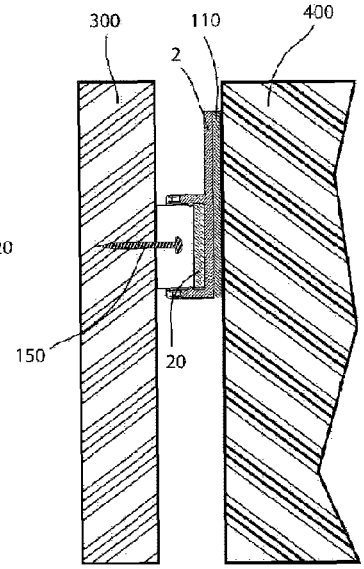
FIG. 8 shows a cross sectional view of the hanger, the guide cap, the foam covered with adhesives, the wood frame, the first fastener and a wall in a third state, wherein the foam covered with adhesives has been attached to the wall.

FIG. 8 shows a cross sectional view of the hanger 20, the guide cap 2, the foam 110, the wood frame 300, the first fastener 150 and a wall 400 in a third state, wherein the foam 110 has been attached to the wall 400.

Figure 9:
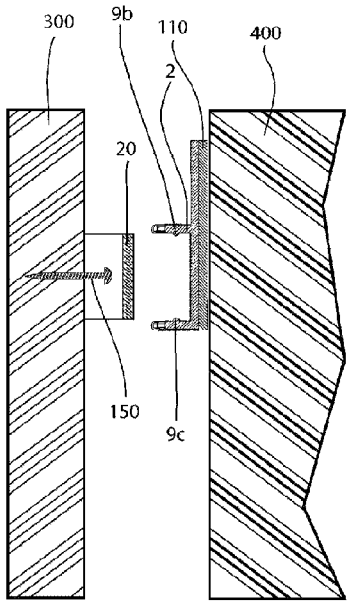
FIG. 9 shows a cross sectional view of the hanger, the guide cap, the foam covered with adhesives, the wood frame, a first fastener, and the wall in a fourth state, wherein the foam covered with adhesives has been attached to the wall, and the hanger has been removed from the guide cap.

FIG. 9 shows a cross sectional view of the hanger 20, the guide cap 2, the foam 110, the wood frame 300, the first fastener 150, and the wall 400 in a fourth state, wherein the foam 110 has been adhered to the wall 400, and the hanger 20 has been removed from the guide cap 2.

Figure 10:
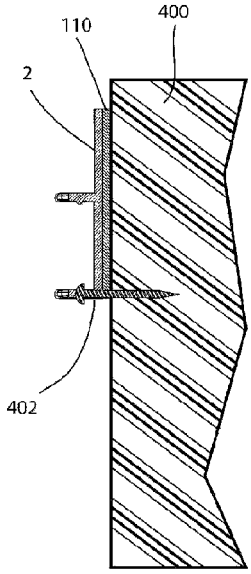
FIG. 10 shows a cross sectional view of the guide cap, the foam covered with adhesives, a second fastener, and the wall in a fifth state, wherein the second fastener has been inserted through an opening in the guide cap and the foam covered with adhesives and into the wall.

FIG. 10 shows a cross sectional view of the guide cap 2, the foam 110, a second fastener 402, and the wall 400 in a fifth state, wherein the second fastener 402 has been inserted preferably into a gap or notch, such as into gap or notch 10*f*, between two teeth of teeth 11 in the guide cap 2 (shown in FIG. 4B) and into the wall 400.

Figure 11:
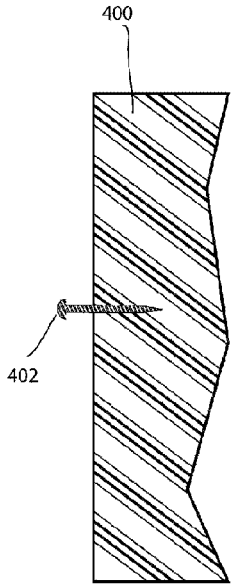
FIG. 11 shows a cross sectional view of the second fastener, and the wall in a sixth state, wherein the second fastener has been inserted through into the wall, and the guide cap has been removed.

FIG. 11 shows a cross sectional view of the second fastener 402 and the wall 400 in a sixth state, wherein the second fastener 402 has been inserted through into the wall 400.

Figure 12:
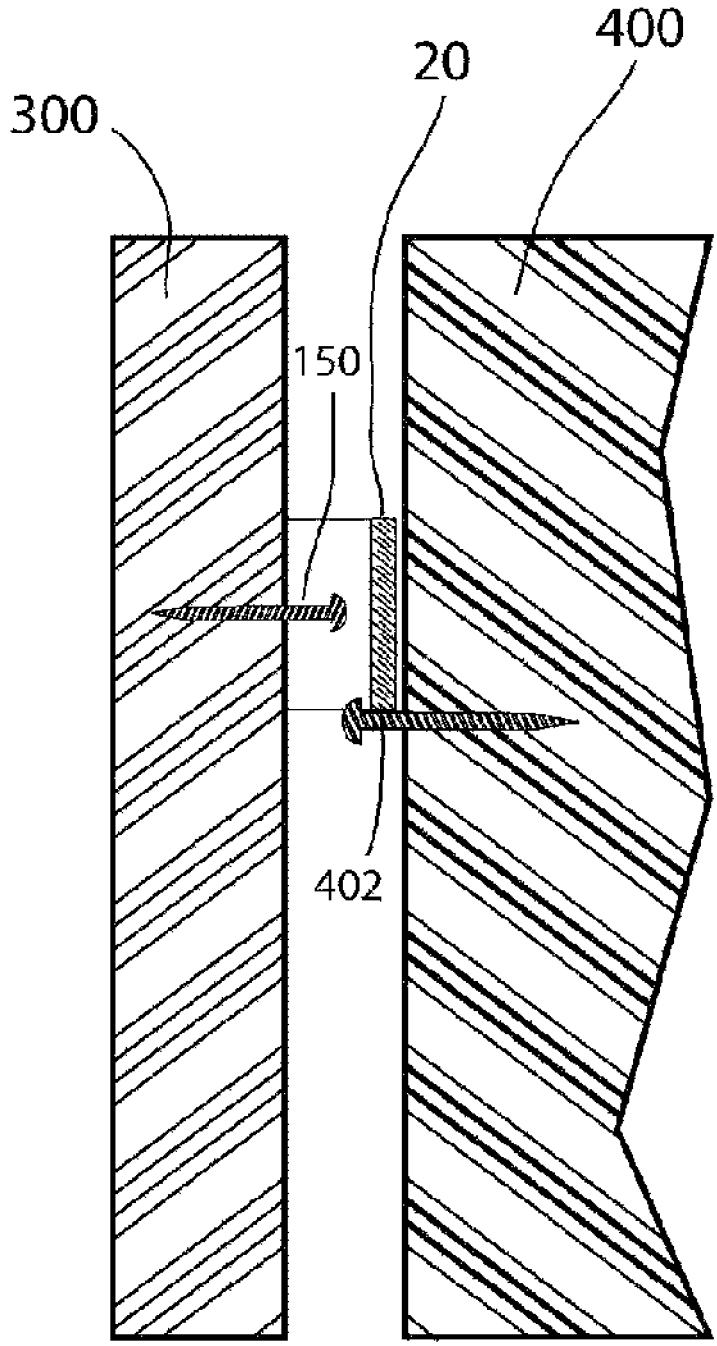
FIG. 12 shows a cross sectional view of the first fastener, the frame, the hanger, the second fastener, and the wall in a seventh state, wherein the first fastener is inserted into the frame, the second fastener is inserted into the wall, the hanger is attached to the frame and then hung on the second fastener on the wall.

FIG. 12 shows a cross sectional view of the first fastener 150, the frame 300, the hanger 20, the second fastener 402, and the wall 400 in a seventh state, wherein the first fastener 150 is inserted into the frame 300, the second fastener 402 is inserted into the wall 400, the hanger 20 is attached to the frame 300, and then hung on the second fastener 402 on the wall 400.

In operation, the protrusions or portions 9*b*, 9*c*, 9*d*, and 9*e*, of the guide cap 2 control the release of the hanger 20.

In operation, the back surface 100*b* (shown in FIG. 4A) of the cover 100 is identified, when the apparatus 1 of FIG. 1 is in an assembled state. The backing or cover 100 is then taken off as shown by FIGS. 6-7, exposing an adhesive side of foam 110. The middle triangular opening 10*a* of the apparatus 1 (without the cover 100) is then aligned with a point on a vertical line which bisects the frame 300. Thus the vertical line will also bisect the guide cap 2. Fasteners 150 and 152 can then be inserted through openings 34*a* and 24*a*, respectively, and into frame 300. This secures (at least temporarily) the foam 110, guide cap 2, and the hanger 20 to the frame 300.

Next the frame 300 is pressed against the wall 400 so that the adhesive side of foam 110 presses against the wall 400. This results in the foam 110 adhering to the wall 400 and when the frame 300 is pulled away the foam 110 and the guide cap 2 remain adhered to the wall 400. The hanger 20 remains fixed to the frame 300. With the guide cap 2 adhered to the wall 400, a nail or other fastener, such as 402 in FIGS. 10-11, is inserted into the wall 400 under the middle V groove such as under notch l0*f*, between two teeth of teeth 11 of the guide cap 2 as shown in FIG. 5B. The fastener 402 is typically not inserted all the way into the wall, but rather a spacing of 2-3 millimeters from the wall is left. Next the guide cap 2 (and the foam 110) is removed from the wall 400. The picture frame 300 is then hung on the fastener 402 by putting the hanger 20 over the fastener 402 so that the fastener is beneath the plate 21 inside of a middle notch 20*b* between two teeth of teeth 20*a*.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

What is claimed is:

1. A method for hanging a picture frame comprising:

attaching an apparatus to a picture frame using a first set of one or more fasteners;

removing an adhesive cover from the apparatus to reveal an adhesive surface;

while the apparatus, without the adhesive cover, is still attached to the picture frame, pressing the apparatus against a surface of a wall so that the adhesive surface adheres to the surface of the wall;

detaching a first part of the apparatus from a second part of the apparatus so that the first part of the apparatus remains attached to the picture frame by the first set of one or more fasteners and the second part of the apparatus adheres to the wall;

inserting a second set of one or more fasteners into the wall using the second part of the apparatus as a guide; and hanging the first part of the apparatus from the second set of one or more fasteners so that the picture frame also hangs from the second set of one or more fasteners; and further comprising removing the second part of the apparatus from the wall, after the second set of one or more fasteners is inserted into the wall using the second part of the apparatus as a guide;

wherein when the first part of the apparatus is hung from the second set of one or more fasteners, the second part of the apparatus is not attached to the wall and is not attached to the picture frame;

wherein the second part of the apparatus includes a plurality of notches, including a central notch;

wherein there is a central marking above the central notch;

and wherein at least one of the second set of fasteners is inserted under the central notch and into the wall.

2. The method of claim 1 wherein the second part of the apparatus has at least one top section, at least one bottom section, at least one right side section, and at least one left side section which together form an at least partially enclosed area into which a substantial portion of the first part of the apparatus can be inserted.

3. An apparatus for hanging a picture frame comprising:

an adhesive cover;

an adhesive surface;

a guide cap; and a hanger;

wherein the adhesive cover, the adhesive surface, the guide cap, and the hanger are attached to each other;

wherein the apparatus can be attached to a picture frame using a first set of one or more fasteners;

wherein the adhesive cover can be removed from the apparatus to reveal the adhesive surface;

wherein while the apparatus, without the adhesive cover, is still attached to the picture frame by the first set of one or more fasteners, the apparatus can be pressed against a surface of a wall so that the adhesive backing adheres to the surface of the wall;

wherein the hanger can be detached from the guide cap so that the hanger remains attached to the picture frame by the first set of one or more fasteners and the guide cap adheres to the wall;

wherein a second set of one or more fasteners can be inserted into the wall using the guide cap as a guide;

wherein the hanger can be hung from the second set of one or more fasteners so that the picture frame also hangs from the second set of one or more fasteners;

wherein the guide cap has at least one top section, at least one bottom section, at least one right side section, and at least one left side section which together form an at least partially enclosed area into which a substantial portion of the hanger can be inserted;

wherein the guide cap includes a plurality of notches, including a central notch;

wherein there is a central marking above the central notch;

wherein the hanger has a plurality of notches;

wherein the guide cap has an enclosed area, the enclosed area having the same shape as the hanger;

wherein the hanger is fitted within the enclosed area of the guide cap; and wherein at least one of the second set of fasteners can be inserted under the central notch and into the wall.

4. A method for hanging a picture frame comprising:

attaching an apparatus to a picture frame using a first set of one or more fasteners;

while the apparatus, is still attached to the picture frame, pressing the apparatus against a surface of a wall so that an adhesive surface adheres to the surface of the wall;

detaching a first part of the apparatus from a second part of the apparatus so that the first part of the apparatus remains attached to the picture frame by the first set of one or more fasteners and the second part of the apparatus adheres to the wall;

inserting a second set of one or more fasteners into the wall using the second part of the apparatus as a guide; and hanging the first part of the apparatus from the second set of one or more fasteners so that the picture frame also hangs from the second set of one or more fasteners;

wherein the first part of the apparatus is comprised of an elongated plate, first and second inclined plates, and first and second further plates;

wherein the first and second inclined plates are at an angle with respect to the elongated plate;

wherein the elongated plate has a first end and an opposing second end, the first end of the elongated plate fixed to the first inclined plate, and the second end of the elongated plate fixed to the second inclined plate; and wherein the first further plate is substantially parallel to the elongated plate and is fixed to the first elongated plate, and the second further plate is substantially parallel to the elongated plate and is fixed to the second elongated plate.

5. The method of claim 4 further comprising removing the second part of the apparatus from the wall, after the second set of one or more fasteners is inserted into the wall using the second part of the apparatus as a guide; and wherein when the first part of the apparatus is hung from the second set of one or more fasteners, the second part of the apparatus is not attached to the wall and is not attached to the picture frame.

6. The method of claim 4 wherein the elongated plate includes a plurality of notches.

7. The method of claim 4 wherein the second part of the apparatus includes at least one top section, at least one bottom section, at least one right side section, and at least one left side section which together form an at least partially enclosed area into which the elongated plate of the first part of the apparatus, and a substantial portion of the first and second inclined plates of the first part of the apparatus can be inserted.

8. The method of claim 4 wherein the first further plate of the first part of the apparatus has an opening through which one of the first set of one or more fasteners can be inserted;

and the second further plate of the first part of the apparatus has an opening through which one of the first set of one or more fasteners can be inserted.

9. The method of claim 7 wherein the second part of the apparatus includes a plate which lies outside of the at least partially enclosed area;

and wherein the plate of the second part of the apparatus has an adhesive.

* * * * *